United States Patent [19]

Wandler

[11] 4,164,783

[45] Aug. 14, 1979

[54] SPORT LIGHT AND BALLAST MODULE

[75] Inventor: Donald Wandler, South Milwaukee, Wis.

[73] Assignee: McGraw-Edison Company, Elgin, Ill.

[21] Appl. No.: 901,811

[22] Filed: May 1, 1978

[51] Int. Cl.[2] ..... H01R 33/00

[52] U.S. Cl. ..... 362/226; 362/1; 362/267; 362/371

[58] Field of Search ..... 362/1, 2, 33, 216, 226, 362/177, 254, 255, 310, 267, 282, 368, 370, 371, 372, 432

[56] References Cited

U.S. PATENT DOCUMENTS

| | | | |
|---|---|---|---|
| 1,461,285 | 7/1923 | Olsen | 362/226 X |
| 1,687,821 | 10/1928 | Aldeen | 362/371 X |
| 2,074,404 | 3/1937 | Kolb | 362/371 |
| 3,604,916 | 9/1971 | Adra et al. | 362/267 |
| 3,714,415 | 1/1973 | Stephensen | 362/370 |
| 3,718,816 | 2/1973 | Seelbach et al. | 362/226 X |
| 3,725,695 | 4/1973 | Eversberg et al. | 362/226 X |
| 3,903,409 | 9/1975 | Richilano | 362/370 |
| 3,965,346 | 6/1976 | Thompson, Jr. | 362/371 X |
| 4,051,362 | 9/1977 | Guggemos | 362/432 |

*Primary Examiner*—Peter A. Nelson

*Attorney, Agent, or Firm*—Ronald J. LaPorte; Jon C. Gealow; Dale A. Kubly

[57] ABSTRACT

A weather-proof light fixture includes a quick connect modular ballast assembly which is separably connected to a light reflector member mounted on a support surface. A housing containing the ballast assembly has a lamp receptacle extending from a sidewall thereof. The light reflector member includes a neck portion the end of which is butted against the housing, receiving the lamp receptable therein. Outwardly projecting fastener arms extending from the neck portion each having a hollow cavity therein are rotated over posts protruding from the ballast housing sidewall, and located adjacent the lamp receptacle. Slots contained within the fastener arms receive screw fasteners extending from the posts to secure the lamp ballast housing and reflector member in a joined condition. A gasket disposed between the end of the neck portion and housing side wall, renders the light fixture waterproof.

6 Claims, 5 Drawing Figures

SPORT LIGHT AND BALLAST MODULE

BACKGROUND OF THE INVENTION

The invention relates generally to weather-proof light fixtures including a ballast assembly which is separably connected to a light reflector member secured to a mounting surface.

Weather-proof light fixtures, such as those used for night-time sports activities, security perimeters, loading ramps, and parking facilities include sealed weather-proof optical systems and a lamp ballast such as the kind required for high intensity discharge lamps. In servicing the lamp assembly of such lights, the user is frequently required to remove the ballast assembly for prolonged service at a remote site. However, in such situations it is not desirable to remove the remainder of the lamp assembly. Also, if the ballast assembly should fail in service, such as during a night-time performance, it would be advantageous to quickly interchange ballast assemblies while leaving the remainder of the light fixture mounted in position.

SUMMARY OF THE INVENTION

Accordingly, it is an object of this invention to provide a lamp assembly with reflector and mounting means separate from the ballast assembly. It is also an object of this invention to provide a modular ballast assembly capable of quick removal from the remainder of the lamp fixture. Since it is sometimes necessary to perform minor repairs to the ballast assembly, it is an object of this invention to provide a modular ballast assembly which is accessible for service while attached to the lamp fixture.

Other objects and further details of that which are believed to be novel in the invention will be clear from the following description and claims taken with the accompanying drawing, which illustrates an exemplary embodiment of the subject invention.

DESCRIPTION OF THE PREFERRED EMBODIMENT

Figure 1:
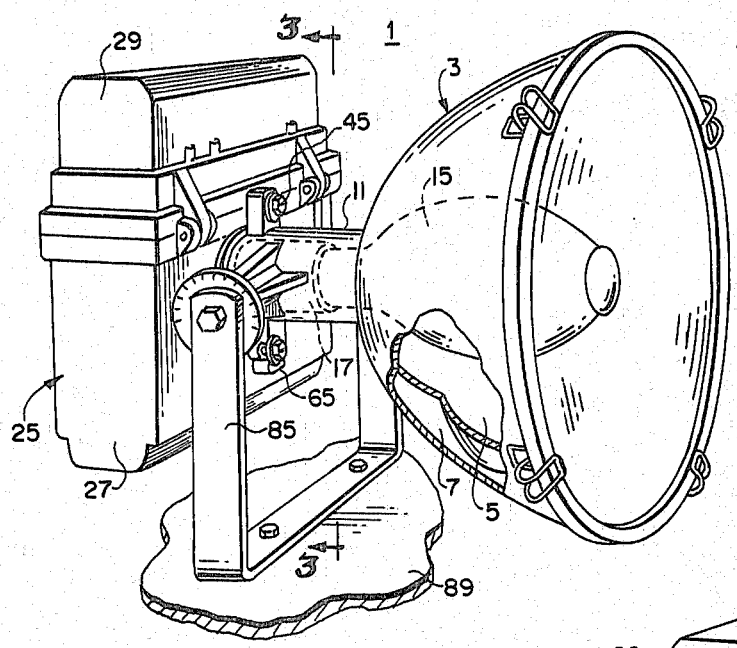
FIG. 1 is a perspective view of the light fixture according to the invention, shown mounted on a support surface.

One form of the light fixture according to the present invention, for the purposes of disclosure, is shown in FIGS. 1-5. Referring especially to FIG. 1, the light fixture 1 includes a reflector member 3 having a concave inner surface or reflector portion 5 mounted in a shroud 7 having a convex outer surface. An optical support or tubular neck portion 11 of cast metal construction is joined to and extends outwardly from the shroud. Neck portion 11 is designed to receive the base 13 of lamp bulb 15 inserted into shroud 7. A cast metal housing 25 containing a ballast assembly (not shown) has a first portion 27 to which a second portion 29 is hingedly attached. A suitable seal (not shown) is provided between the housing portions to make it water tight when the portions are joined. A lock (not shown) secures the portions in a joined condition. A lamp receptacle 17 is mounted to a flat end wall 33 of housing 25 on portion 27. Two elongated posts or protrusions 43 located on opposite sides of the lamp receptacle 17 extend outwardly from surface 33. Protrusions 43 receive elongated fasteners 45. In the preferred embodiment protrusions 43 include axial cavities which are threaded internally to receive screw-type fasteners.

Figure 2:
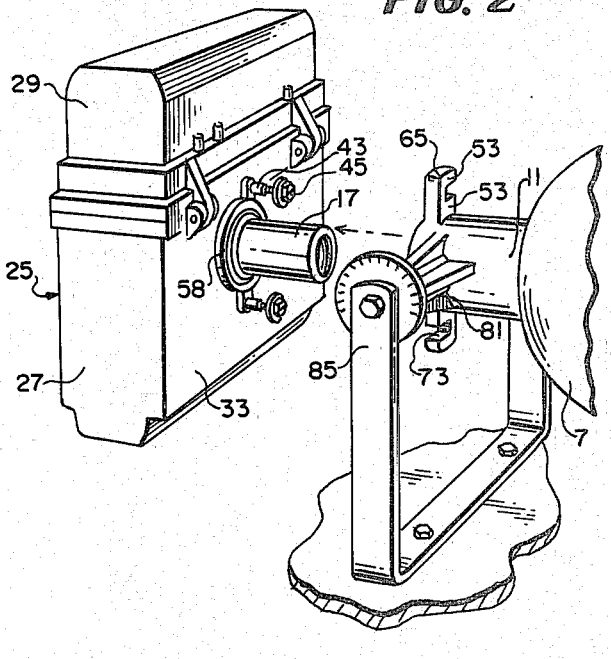
FIG. 2 is a detailed perspective view showing the modular ballast assembly removed from the remainder of the light fixture.
Figure 5:
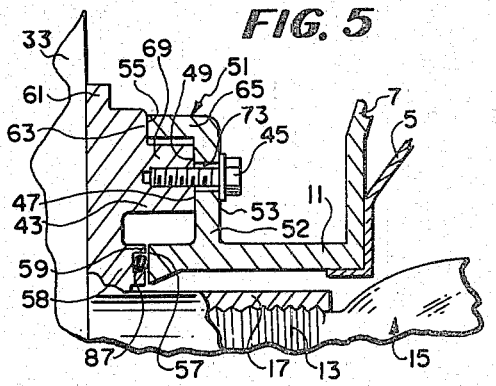
FIG. 5 is a cross-sectional view of the fastening means shown in FIG. 3 taken along lines 5—5.

As is best shown in FIGS. 2 and 5, fastener arms 51 are provided at the free end of neck 11 and extend radially outwardly therefrom in opposing directions. Each fastener arm defines a cavity 69 and includes a first wall 52, the outer surface 53 (FIG. 5) of which, upon joining the neck portion 11 and ballast housing 25, is contacted by the head of a corresponding screw fastener 45. Cavity 69 further includes a second surface 55, which contacts flat surface 63 of a corresponding raised portion 61, a pair of which is formed on side wall 33 about the base of protrusion 43, respectively. A raised collar portion 58 is formed about the base of lamp receptacle 17, between portions 61. Surface 59 of portion 58 is contacted by end surface 57 of neck portion 11 upon joining the latter to ballast housing 25. As shown in FIG. 5, the light fixture 1 is assembled, with housing 25 butted against the free end of neck portion 11. The outer end 47 of protrusion 43 contacts the inner surface 49 of wall 52, internally of cavity 69, while surface 55 contacts surface 63. It can be seen in FIG. 5 that cavity 69 receives protrusion 43, opening in the same direction as the opening in neck portion 11 which receives lamp receptacle 17. The joinder of neck portion 11 at portion 61 of the ballast housing 25 creates a metal to metal seal. A gasket ring 87 is included between surface 55 of the neck portion 11 and portion 61 to ensure a water tight seal therebetween.

Figure 3:
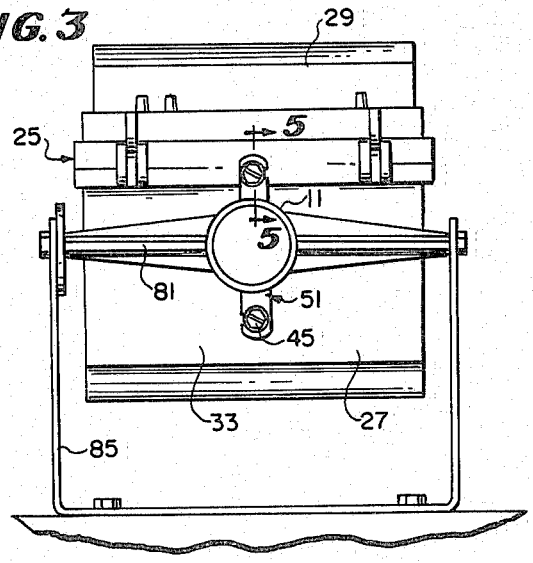
FIG. 3 is a sectional elevation view taken along lines 3—3 of FIG. 1.
Figure 4:
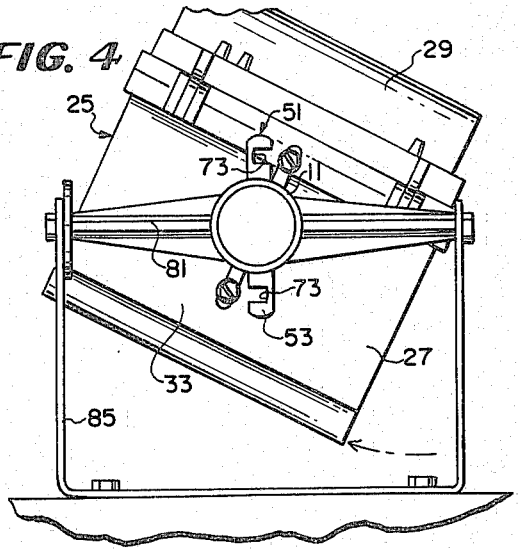
FIG. 4 is a sectional elevational view of FIG. 3 with the modular ballast assembly shown in the initial stages of removal.

As can best be seen in FIGS. 2-4, the preferred embodiment of fastener arms 51 includes inwardly extending opposing slots 73 for receiving screw fasteners 45 when weather-proof housing 25 is rotated into secured engagement with the free end of neck portion 11. Support members 81 which extend from the free end of neck portion 11 are provided to support the entire lamp fixture on a support surface such as 89. The support members 81 are joined pivotally at the free ends thereof to a support bracket 85 which in turn is fastened to support surface 89.

To mount the light fixture 1, support bracket 85 is secured to support surface 89. The reflector member 3 is mounted to member 85 through its outwardly extending support members 81. Thereafter, housing 25 containing the ballast assembly and other necessary electrical components, is joined to the mounted reflector member 3 by inserting lamp receptacle 17 into the open or free end of neck portion 11 and simultaneously aligning surface 55 of the fastener arms 51 and surface 57 of the neck portion 11 with surfaces 63 and 59 respectively. The free end surface 57 of neck portion 11 contacts gasket member 87 which provides a weather-tight seal between the housing and reflector members. Housing 25 is then rotated, enclosing protrusions 43 in respective cavities 69 in fastener arms 51 and guiding screw fasteners 45 into slots 73. To hold the members in secured relationship, screw members 45 are drawn into engagement with the ballast housing 25.

It is thus seen that a light fixture is provided with a modular ballast assembly capable of being quickly removed from the remaining components of the light fixture. Also, while assembled, access to the interior of housing 25 is provided through hingedly mounted portion 29 providing access to the electrical components within.

I claim:

1. A light fixture including in combination:

a weather-proof housing enclosing electrical components including ballast means, said housing having a side wall;

a lamp receptacle mounted on said side wall extending outwardly therefrom substantially at right angles thereto;

a pair of elongated protrusions of predetermined length projecting outwardly from said side wall and located on opposite sides of said lamp receptacle, flat surface means surrounding said lamp receptacle;

a reflector member having a reflector portion and a neck portion extending outwardly therefrom with the free end of said neck portion being opened;

fastening means located adjacent the free end of said neck portion, said fastening means including first and second arms extending radially outwardly therefrom in different directions, each arm defining a cavity opening in the same direction as the free end of said neck portion, and a slot communicating with said cavity, said slot for receiving an elongated fastener extending parallel to the axis of the neck, and the cavity for receiving a corresponding elongated protrusion mounted on said housing;

gasket means disposed between said flat surface means surrounding said lamp receptacle and said free end of said neck portion for providing a weather-proof seal;

said flat surface means surrounding said lamp receptacle mating with the free end of said neck portion and said lamp receptacle being received in said neck portion upon joining said lamp housing and said reflector member, with said protrusions being received in said cavities formed in said fastening means, with said elongated fasteners being received in said slots subsequent to joining said ballast housing and reflector member and rotating one of said ballast housing and reflector member relative to the other to secure the latter in a sealed condition.

2. A lamp fixture as recited in claim 1 wherein said weatherproof housing is comprised of two portions hingedly mounted together for access to the interior of said housing, a first portion including said side wall, the second portion being movable to provide access to the interior of said housing when said first portion abuts the neck portion of said reflector.

3. The light fixture recited in claim 1 wherein a first flat surface means formed on said side wall surrounds said protrusions and wherein said arms include second flat surface means surrounding said cavities for engagement with said first flat surface means.

4. The light fixture recited in claim 1 wherein said elongated fasteners are screws with enlarged head portions and said protrusions have axial cavities internally threaded to receive said screw fasteners.

5. The light fixture recited in claim 1 wherein said first and second arms each have opposing side edges and an end edge located opposite said neck portion, said slots extend into said respective cavities from the leading side edges of said first and second arms when one of said housing and said reflector member is rotated relative to the other for engagement of said elongated fasteners in said slots.

6. The light fixture recited in claim 1 wherein each said inwardly extending slot extends in a direction perpendicular to an axially extending plane intersecting the axis of said neck portion.

* * * * *